US006361044B1

(12) United States Patent
Block et al.

(10) Patent No.: US 6,361,044 B1
(45) Date of Patent: Mar. 26, 2002

(54) CARD DEALER FOR A TABLE GAME

(76) Inventors: Lawrence M. Block, 3051 Kishner Dr., Apt. 109, Las Vegas, NV (US) 89109; Harold E. Koester, 5413 Dilly Cir., North Las Vegas, NV (US) 89031

( * ) Notice: Subject to any disclaimer, the term of this patent is extended or adjusted under 35 U.S.C. 154(b) by 0 days.

(21) Appl. No.: 09/511,289

(22) Filed: Feb. 23, 2000

(51) Int. Cl.[7] ..... A63F 1/12

(52) U.S. Cl. ..... 273/149 R; 273/309; 273/148 R; 273/149 P

(58) Field of Search ..... 273/149 R, 149 P, 273/157 A, 292, 309, 148 R

(56) References Cited

U.S. PATENT DOCUMENTS

| | | | | | |
|---|---|---|---|---|---|
| 629,470 | A | * | 7/1899 | Rollins | 273/149 R |
| 676,639 | A | * | 6/1901 | Stroud | 273/149 R |
| 2,696,385 | A | * | 12/1954 | Hadfield et al. | 273/149 |
| 2,760,779 | A | * | 8/1956 | Ogden et al. | 273/149 |
| RE24,986 | E | * | 5/1961 | Stephenson | 273/149 |
| 3,057,625 | A | * | 10/1962 | Livingston | 273/148 |
| 3,588,116 | A | * | 6/1971 | Muira | 273/149 |
| 4,033,590 | A | * | 7/1977 | Pic | 273/149 R |
| 4,264,074 | A | * | 4/1981 | Sobajima | 273/149 R |
| 4,534,561 | A | * | 8/1985 | Okuno et al. | 273/149 R |
| 5,114,153 | A | * | 5/1992 | Rosenwinkel et al. | 273/292 |
| 5,199,710 | A | * | 4/1993 | Lamle | 273/149 R |
| 5,722,893 | A | * | 3/1998 | Hill et al. | 463/47 |
| 6,039,650 | A | * | 3/2000 | Hill | 463/47 |
| 6,126,166 | A | * | 10/2000 | Lorson et al. | 273/148 R |

* cited by examiner

*Primary Examiner*—Benjamin H. Layno
*Assistant Examiner*—Dolores R. Collins
(74) *Attorney, Agent, or Firm*—Leonard Weiss

(57) ABSTRACT

A top of a card table with a card dispensing hole therethrough and an arcuate edge is covered by a transparent dome shaped cover. A dealer position is centrally located on the table top. A plurality of player stations are evenly spaced along the arcuate edge. A rotatable card placement assembly includes an extendable arm that is connected to a card carrier that is operable to carry a card. In response to signals from the computer, the rotation of the assembly and the extension of the arm cause the card carrier to carry the card from the card dispensing hole to either the dealer position or any of the player positions. The card carries a bar code identification thereon. A bar code reader of the card carrier provides a signal representation of the identification of the card to the computer.

21 Claims, 14 Drawing Sheets

CARD DEALER FOR A TABLE GAME

BACKGROUND OF THE INVENTION

1. Field of Invention

This invention is in the general field of table games and, more particularly, is an apparatus that mechanically deals playing cards to players of a table game and electronically controls the game.

2. Description of the Prior Art

Table games in a casino are usually grouped in an area managed by a floor person provided by the casino. The casino additionally provides a dealer at each table where a table game is played. It should be understood that the floor person and the dealer are paid employees of the casino. Therefore, when the casino is a host to the table game, salaries of the floor person and the dealer are sustained as a core expense of the casino.

In blackjack, for example, a player competes against the casino. There is frequently a dishonest player and a dishonest dealer who cheats at blackjack. Since the player competes against the casino, cheating is sustained as a core expense of the casino. Additionally, the cheating creates an environment that many casino patrons seek to avoid.

Because of the cheating, there is typically a strategic placement of security personnel and surveillance cameras in the casino. The security personnel and the cameras reduce the cheating. Salaries of the security personnel and the cost of the cameras are sustained as a core expense of the casino.

The payment of the salaries of the security personnel and the cost of the cameras are substantially reduced when the casino is a host to a slot machine because construction of the slot machine makes cheating difficult. Additionally, there is no need for the dealers and the floor person. It would be desirable for the casino to be a host to a table game that has many of the characteristics of the slot machine.

SUMMARY OF THE INVENTION

According to the present invention, a top of a card table has a card dispensing hole therethrough. The table top is covered by a transparent, dome shaped cover. The table top has a dealer position centrally located thereon and a player position proximal to an arcuate edge of the table. An extendable arm is included in a card placement assembly that is rotatable about a center of curvature of the edge. The arm has an end connected to a card carrier that is operable to carry a card. The extension of the arm and the rotation of the assembly is controlled by signals from a computer to cause the card carrier to carry the card from the card dispensing hole to either the dealer position or the player position. The card carries a readable code identification thereon. A code reader of the card carrier provides a signal representation of the identification to the computer.

Other objects, features, and advantages of the invention should be apparent from the following description of the preferred embodiment thereof as illustrated in the accompanying drawing.

DESCRIPTION OF THE PREFERRED EMBODIMENT

In this embodiment, a game of blackjack is played where cards are dealt and shuffled but neither a player nor a dealer handles the cards. Because the cards are not handled, the need for the dealer is obviated. Hence, the game has some desirable aspects of a typical card game slot machine. Unlike the slot machine, the cards are shuffled after each game. The shuffle is performed mechanically, unlike an electronic shuffle utilized in the card game slot machine.

Figure 19:
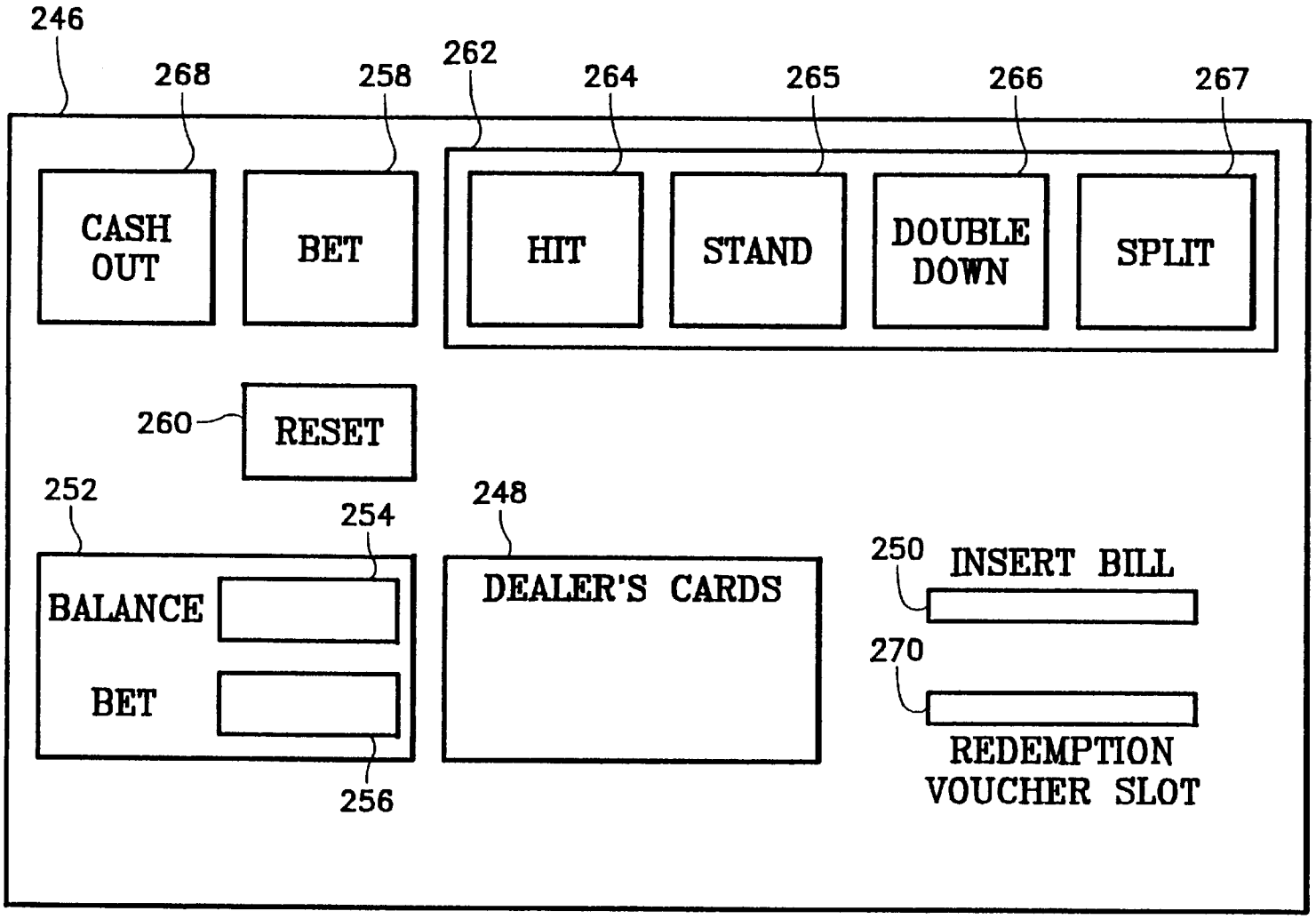
FIG. 19 is a plan view of a player's console.

The game is played with cards that each have two face-up sides. Because there are two face-up sides, a suit and rank of a card that is in view is identifiable by the player. A supplemental view of what are called dealer's cards are provided on a video screen (FIG. 19). Additionally, all mechanical problems of turning a card from its face-down side to its face-up side are obviated.

As shown in FIGS. 1–4, the game is played upon a table 10 (FIG. 1) having a top that is bifurcated to form a lower tier 12 and an upper tier 14. The tiers 12, 14 are covered by a transparent dome shaped cover 16. Therefore, the player cannot handle anything beneath the cover 16.

The tier 12 has an edge that includes straight segments 18, 20, 22. The segments 20, 22 are similar to each other. The segment 18 has ends 18A, 18B connected to an end 20A of the segment 20 and the end 22A of the segment 22, respectively.

The segments 20, 22 additionally have ends 21, 23, respectively. A truncated isosceles triangle is formed by the segments 18, 20, 22 and a line (not shown) that connects the ends 21, 23.

The tier 14 has an arcuate edge 24 with ends 24A, 24B. It should be understood that there is a vertical displacement between the ends 21, 24A and between the ends 23, 24B equal to a displacement between the tiers 12, 14. The edge 24 preferably has a center of curvature at a point 26.

Proximal to the edge 24 are equally spaced player stations 30–35. The stations 30–35 include card receiving areas 30C–35C, respectively, where cards are positioned as described hereinafter.

A dealer station 36 is positioned upon the tier 14 at a central location of the top of the table 10. The dealer station 36 includes a first dealer card placement position 38 where a first dealer card is dealt during play of the game. The station 36 additionally includes a cover 40 made from a rectangular opaque plastic slab. The cover 40 substantially rests upon the tier 14 adjacent to the position 38.

Figure 2:
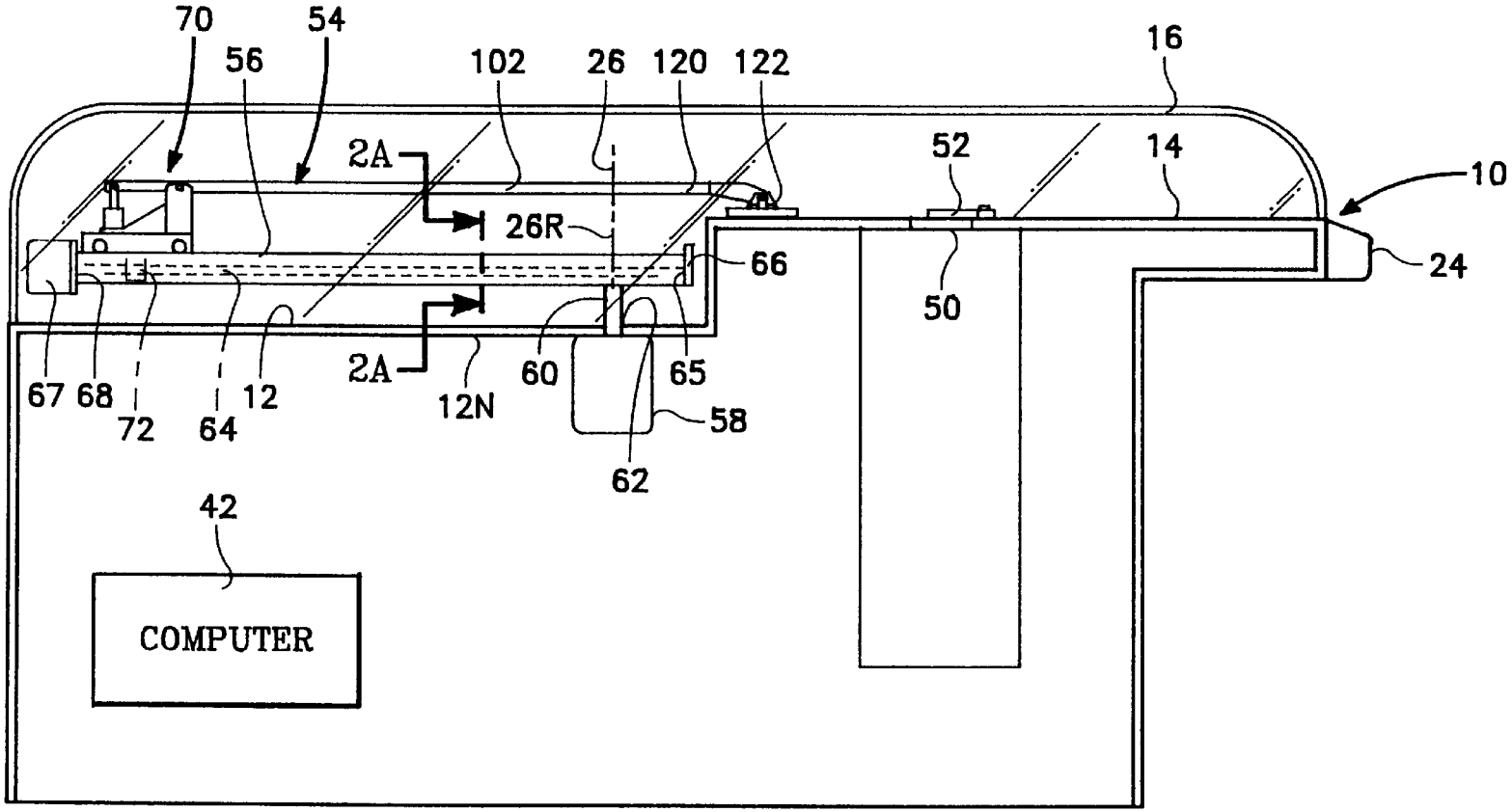
FIG. 2 is a side elevation of the table of FIG. 1.
Figure 4:
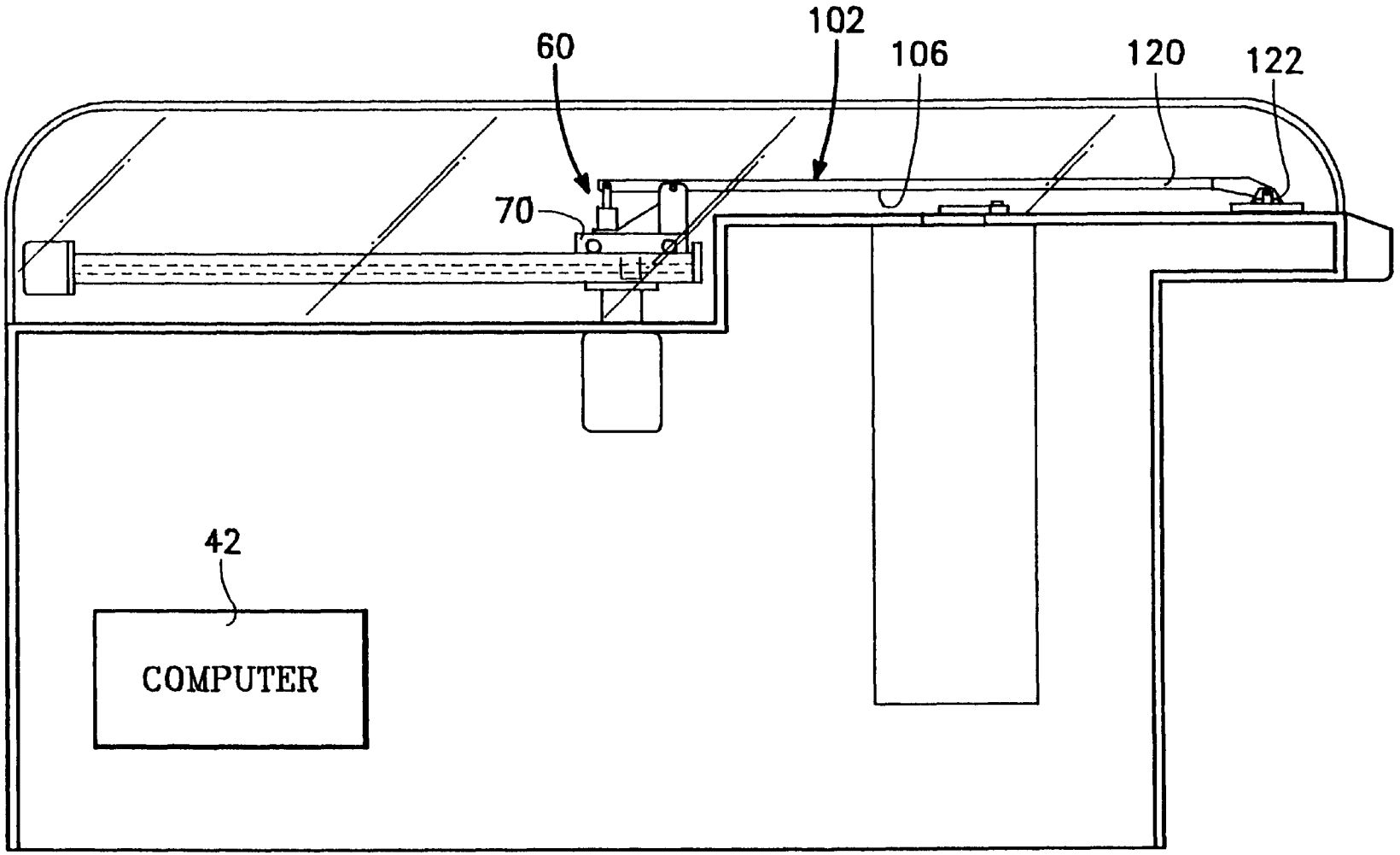
FIG. 4 is a side elevation of the table of FIG. 3.

The cover 40 is operable to shield the first dealer card from view in response to a signal from a computer 42 (FIGS. 2 and 4). Operation of the cover 40 is described more fully hereinafter. Dealer cards, other than the first dealer card, are dealt to a dealer card placement area 44.

Figure 1:
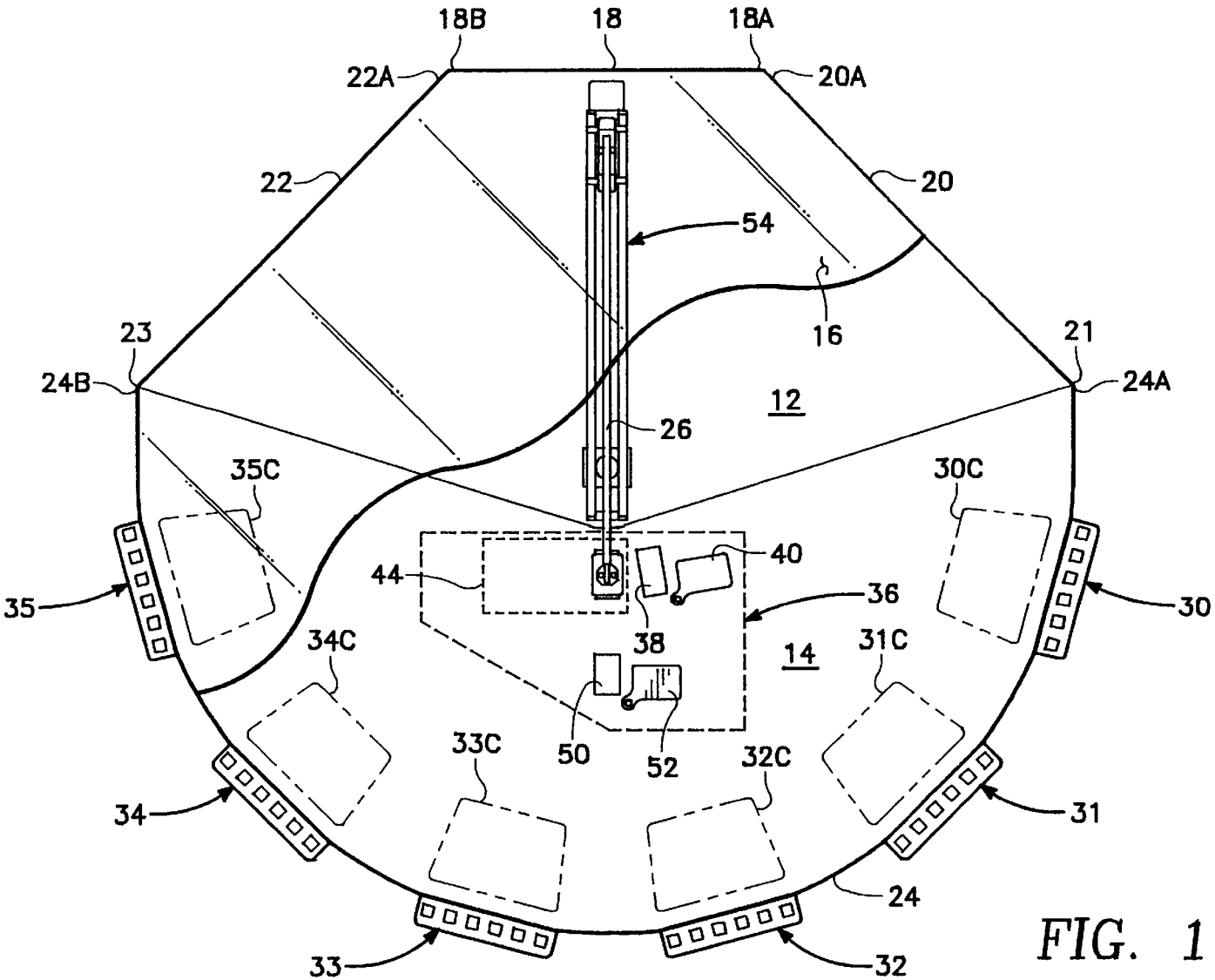
FIG. 1 is a plan view of a table where a portion of a transparent cover is broken away and a card distribution assembly is positioned for delivery of a card to a dealer station.
Figure 3:
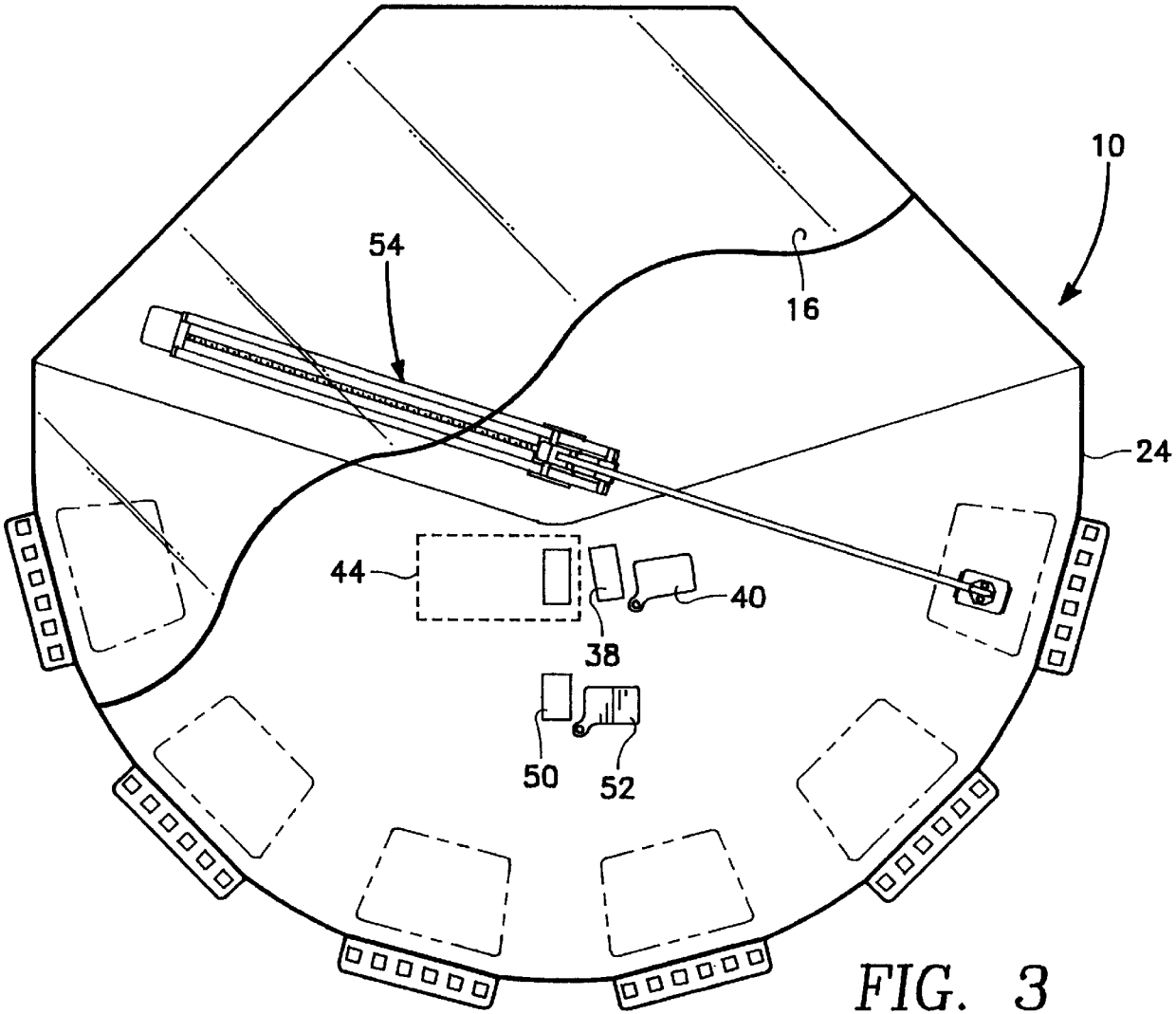
FIG. 3 is a plan view of the table of FIG. 1 where the distribution assembly is positioned for delivery of a card to a player station.

A rectangular card dispensing hole 50 passes through the tier 14 (FIGS. 1 and 3). Dimensions of the dispensing hole 50 are selected to permit passage of a card therethrough. A cover 52, similar to the cover 40, is adjacent to the dispensing hole 50. The cover 52 is operable to shield a card in the dispensing hole 50 from view in response to a signal from the computer 42. As explained hereinafter, cards are placed upon the tier 14 by a card placement assembly 54.

Figure 2A:
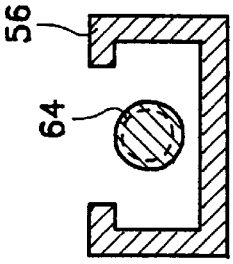
FIG. 2A is a view of a channel and a lead screw in FIG. 2 taken along the line 2A—2A.

As shown in FIGS. 2 and 2*a* the assembly 54 includes a conveyor channel 56 that is connected to a channel rotation stepper motor 58. More particularly, the motor 58 has a shaft 60 that extends through a hole 62 in tier 12 where it is connected to the assembly 54. The motor 58 is connected to an underside 12U of the tier 12.

In response to a signal from the computer 42, the motor 58 rotates the assembly 54 about an axis 26R (FIG. 2) that intersects the point 26. The computer 42 stores a digital signal representation of the rotary position of the assembly 54 in a manner described hereinafter.

The assembly 54 additionally includes a card placement lead screw 64 that has an end 65 within a bearing 66 that is connected to one end of the channel 56. The other end of the channel 56 is connected to a card placement stepper motor 67.

An end 68 of the lead screw 64 is coaxially connected to a shaft (not shown) of the motor 67. In response to a signal from the computer 42, the motor 67 causes the lead screw 64 to axially rotate.

As shown in FIGS. 5–8, the channel 56 carries a conveyor 70 that includes a block 72 with an internally threaded hole 74 therethrough. The lead screw 64 passes through the hole 74 with threads of the lead screw 64 engaging threads within the hole 74. As explained hereinafter, rotation of the lead screw 64 causes the conveyor 70 to move along the channel 56.

The conveyor 70 has a wall 76 with a metal wheel 78 rotatably mounted thereon. The axis of rotation of the wheel 78 is parallel to the tiers 12, 14.

The channel 56 includes lips 80, 82 that are parallel to the tiers 12, 14. When the conveyor 70 moves along the channel 56, the wheel 78 rolls upon the lip 80.

The conveyor 70 has a wall 83 (FIG. 8)with a metal wheel 84, similar to the wheel 78, rotatably mounted thereon. The wheels 78, 84 are coaxial. When the conveyor 70 moves along the channel 56, the wheel 84 rolls upon the lip 82.

In a similar manner, a metal wheel 86, similar to the wheel 78, is rotatably mounted upon the wall 76. When the conveyor 70 moves along the channel 56, the wheel 86 rolls upon the lip 80.

Correspondingly, a metal wheel (not shown), similar to the wheel 78, is rotatably mounted upon the wall 83; it is coaxial with the wheel 86 and rolls upon the lip 82 when the conveyor 70 moves along the channel 56.

Figure 6:
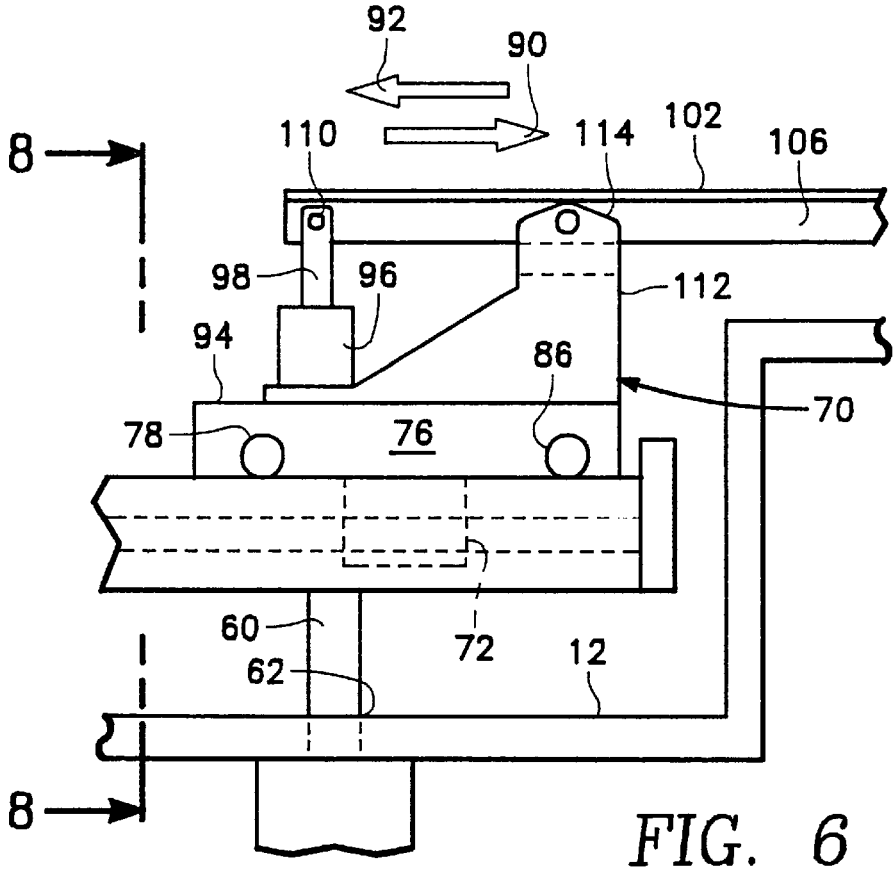
FIG. 6 is a side elevation of the assembly of FIG. 5 where the conveyor is operated to lower the distribution arm.

When the motor 67 (FIG. 2) rotates the lead screw 64 in a clockwise direction, the conveyor 70 moves along the channel 56 in the direction of an arrow 90 (FIG. 6). When the lead screw 64 is rotated in a counter-clockwise direction, the conveyor 70 moves in the direction of an arrow 92. The computer 42 stores a digital signal representation of the position of the conveyor 70 in a manner explained hereinafter.

Because the motor 67 is a stepper motor, the smallest resolvable rotation of the lead screw 64 is in response to a conveyor position pulse provided by the computer 42. In this embodiment, the computer 42 includes a conveyor position counter (not shown) that is incremented in response to the conveyor position pulse causing the conveyor 70 to move in the direction of the arrow 90. Correspondingly, the conveyor position counter is decremented in response to the conveyor position pulse causing the conveyor 70 to move in the direction of the arrow 92. Therefore, the conveyor position counter stores the signal representation of the conveyor 70 position.

The computer 42 additionally includes a rotary position counter (not shown) that is either incremented or decremented by a rotary position pulse provided by the computer 42 to the motor 58 (FIG. 2). The rotary position counter stores a signal representation of the rotary position of the assembly 54 in a manner analagous to the storage of the signal representation of the position of the conveyor 70.

The conveyor 70 has a top surface 94 whereon a solenoid 96 is mounted (FIGS. 5–8). A plunger 98 extends from a central portion 100 of the solenoid 96.

Figure 7:
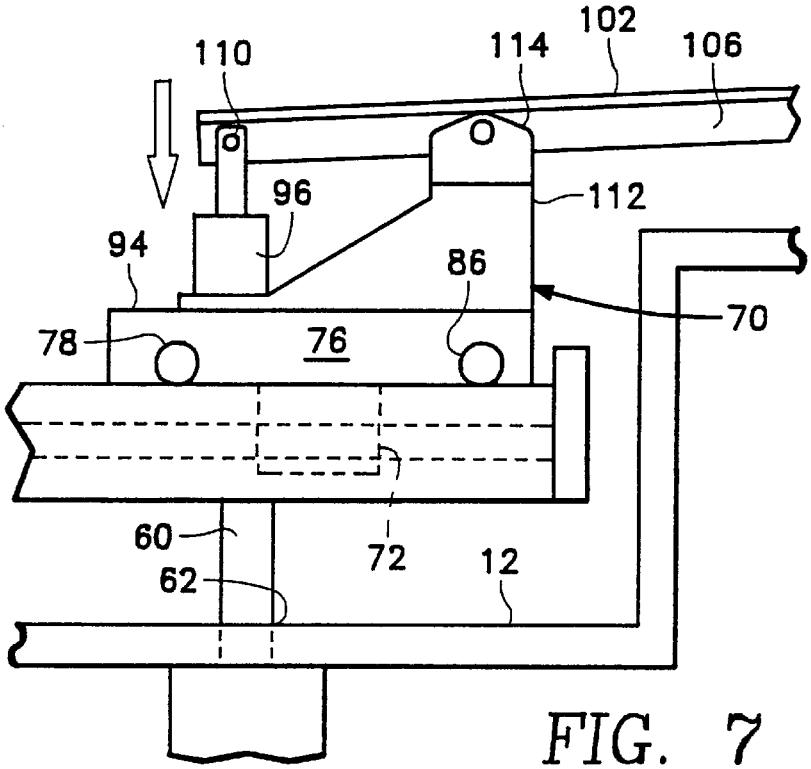
FIG. 7 is a side elevation of the assembly of FIG. 5 where the conveyor is operated to raise the distribution arm.

The solenoid 96 is connected to the computer 42. In response to a signal from the computer 42, the solenoid 96 is operable to alternatively cause the plunger 98 to be fully extended from the central portion 100 (FIG. 6) or to be retracted (FIG. 7).

Figure 5:
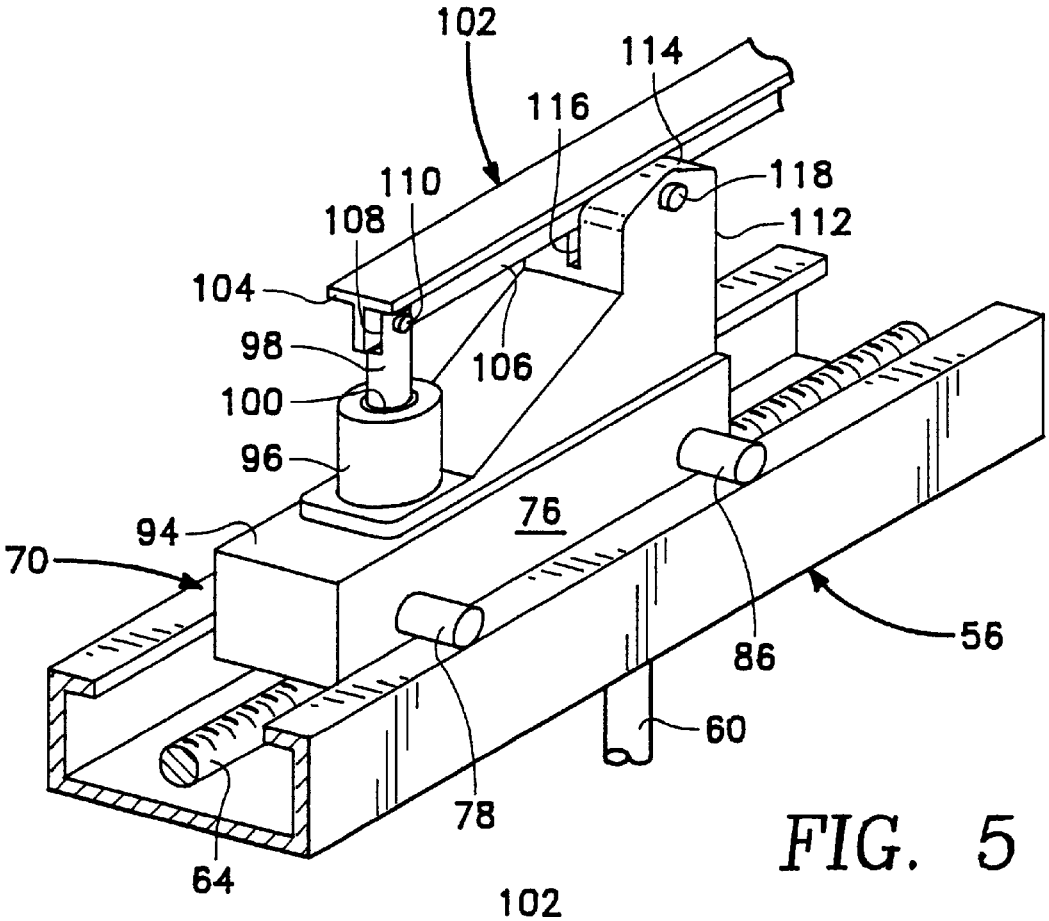
FIG. 5 is a perspective view of an assembly that includes a conveyor channel and conveyor with a card distribution arm thereon.
Figure 8:
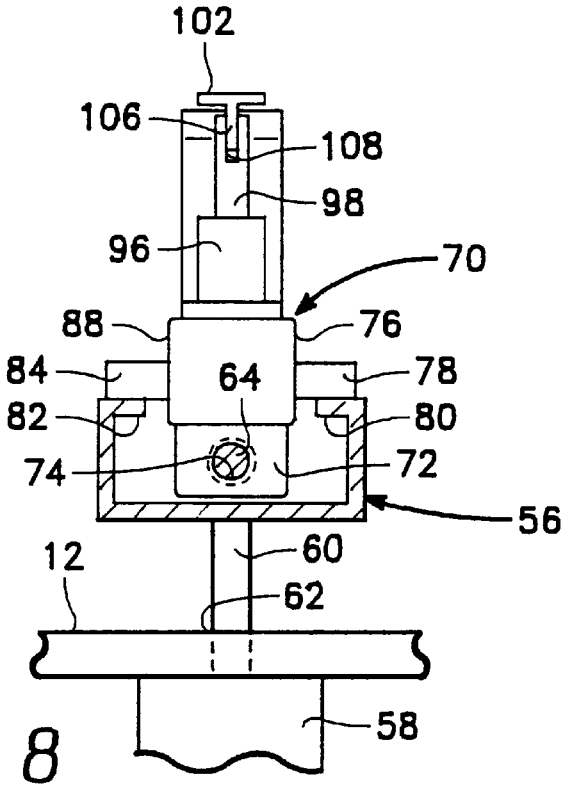
FIG. 8 is a view of FIG. 6 taken along the line 8—8.

The assembly 54 (FIG. 2) includes an extendable arm 102 with a cross-section in the shape of a T (FIG. 8). Proximal to an end 104 of the arm 102, a web 106 of the arm 102 is within a clevis 108 of the plunger 98 (FIG. 5).

The web 106 is maintained within the clevis 108 by a pivot pin 110 (FIGS. 5–7) that passes through the plunger 98 and the web 106. The arm 102 is rotatable about the pin 110.

A support post 112 is connected to the surface 94 and extends generally perpendicularly therefrom. The post 112 has an end 114 with a clevis 116. The web 106 is maintained within the clevis 116 by a pivot pin 118 that passes through the end 114 and the web 106. The arm 102 is rotatable about the pin 118.

The assembly 54 additionally includes a card carrier 122 connected to an end 120 of the arm 102 (FIGS. 2 and 4). Because of the pins 110, 118 (FIGS. 5–8), when the plunger 98 is fully extended (FIG. 6), the arm 102 is substantially parallel to the tiers 12, 14 and the card carrier 122 is proximal to the tier 14. When the plunger 102 is retracted (FIG. 7), the card carrier 122 is about three eighths of an inch above the tier 14.

When the plunger 102 is retracted, the motors 58, 67 can, for example, be used to rotate and extend the arm 106 to cause the card carrier 122 to move to any the stations 30–36 or the card dispensing hole 50 (FIG. 1).

In this embodiment, a magnetic material, such as iron fibers, is embedded within the cards. Additionally, the cards are coated with a non-magnetic, transparent, plastic. When one card rests upon another, the coating creates a space between the cards. As explained hereinafter, the space is important when cards are being moved from the card dispensing hole 50.

An optical identification of each of the cards is provided by each of two bar codes printed thereon. The bar codes are oriented so that the optical identification is provided when a card is rotated one hundred eighty degrees.

Figure 9:
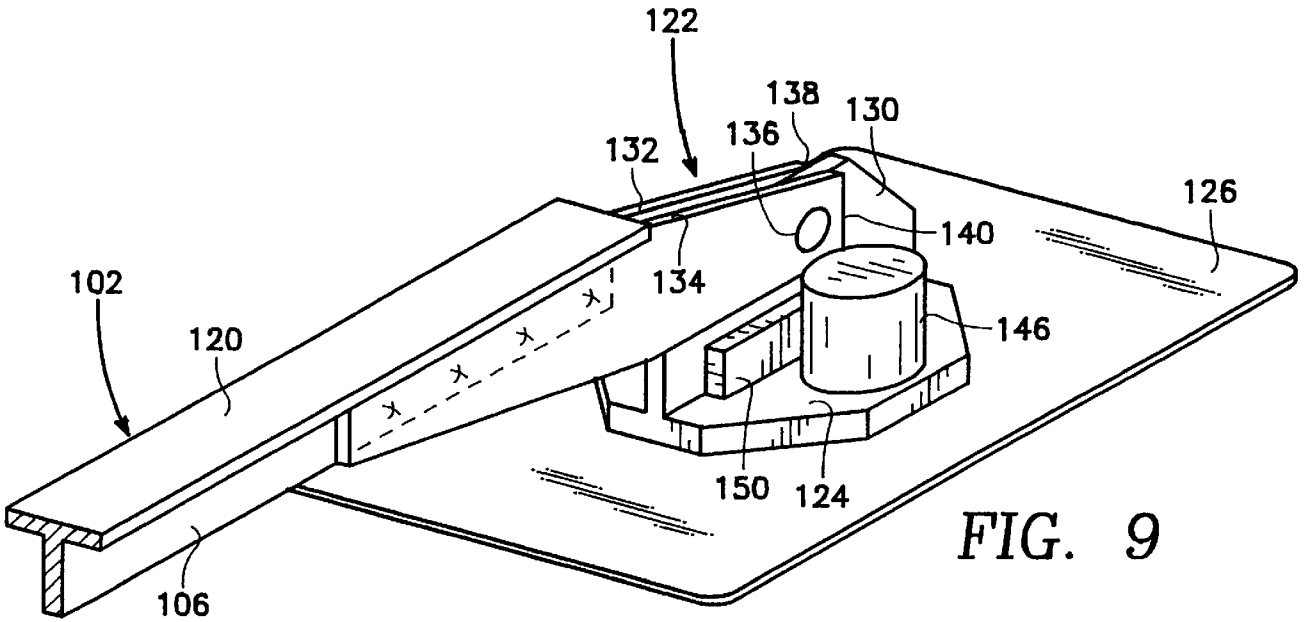
FIG. 9 is a perspective view of a card carrier at an end of the distribution arm of FIG. 5.
Figure 11:
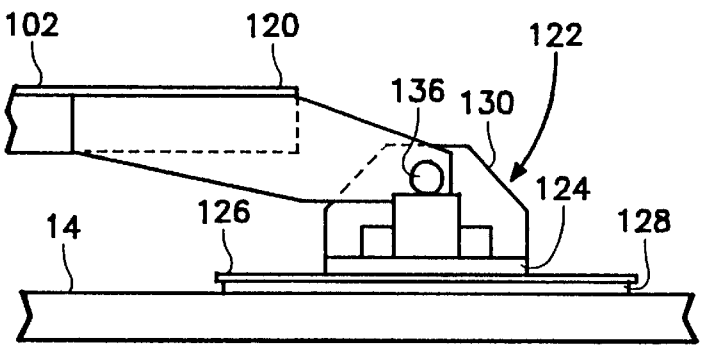
FIG. 11 is a side elevation of the card carrier of FIG. 9.
Figure 10:
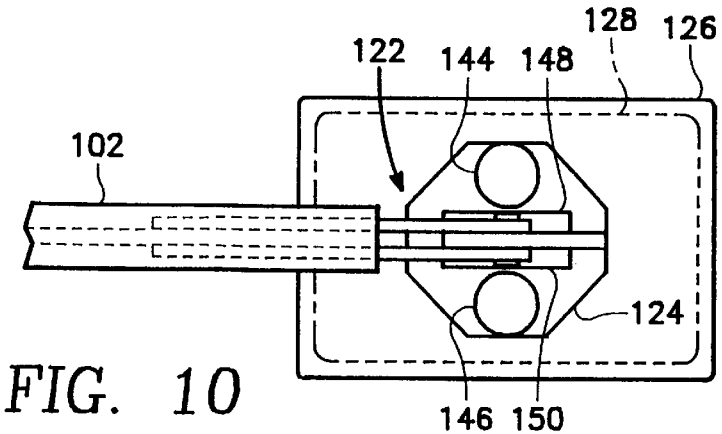
FIG. 10 is a plan view of the card carrier of FIG. 9.

As shown in FIGS. 9–11, the card carrier 122 includes an octagonal base plate 124 that has a bottom surface connected to a cover 126. A card 128 is shielded from view when it is positioned beneath the cover 126.

A post 130 is positioned on a top surface of the plate 124. Clamping plates 132, 134 are positioned on opposite sides of the post 130. A pin 136 passes through the post 130 and the plates 132, 134 at respective ends 138, 140 thereof. Additionally, the plates 132, 134 are welded to opposite sides of the web 106 whereby the arm 102 is connected to the card carrier 122.

Electromagnets 144, 146 are fixedly connected to the card carrier 122. The electromagnets 144, 146 pass through the base 124 and the cover 126 where they are coincident with a boundary between the cover 126 and the card 128. In response to a signal from the computer 42, electrical energy is provided to the electromagnets 144, 146, thereby causing a magnetic attraction between the magnets 144, 146 and the card 128.

Because of the magnetic attraction, the motors 58, 67 can be used to move the card carrier 122 with the card 128 magnetically attached to the cover 126. The space created by the transparent plastic coating of the cards prevents a simultaneous magnetic attachment of two or more cards to the cover 126 when for, example, the card 128 is being moved from the card dispensing hole 50 from the top of a plurality of cards. In an alternative embodiment, a vacuum system is used in place of the electromagnets 144, 146.

When the card 128 is proximal to a desired location, the computer 42 causes a discontinuation of the electrical energy to the electromagnets 144, 146, thereby ending the magnetic attraction. Because the magnetic attraction has ended, the card 128 comes to rest at the desired location.

Bar code readers 148, 150 are fixedly connected to the card carrier 122. The bar code readers 148, 150 pass through the base 124 and the cover 126. Optical inputs of the bar code readers 148, 150 are coincident with the boundary between the cover 126 and the card 128. One of the card readers 148, 150 optically identifies the card 128 resulting in a signal representation of the identification of the card 128 being transmitted to the computer 42. It should be understood that the one of the card readers 148, 150 that optically identifies the card 128 changes when the card 128 is either turned over or rotated one hundred eighty degrees.

As shown in FIGS. 12–16, a card handling unit 152 is mounted on an underside 14U of the tier 14. The unit 152 includes a card shuffler 153 and similar stepper motors 154–159 that have a generally cylindrical housing fixedly connected to walls 160–165, respectively. The motors 154–159 have a central threaded hole therethrough wherein threads rotate in response to a signal from the computer 42. The motors 154–159 are a type of stepper motor that is well known to those skilled in the art.

As explained hereinafter, the unit 152 handles two decks of cards simultaneously. Because two decks of cards are handled simultaneously, there is a reduced time between successive games. In an alternative embodiment, more than two decks are handled simultaneously to further reduce the time between the successive games.

Figure 17:
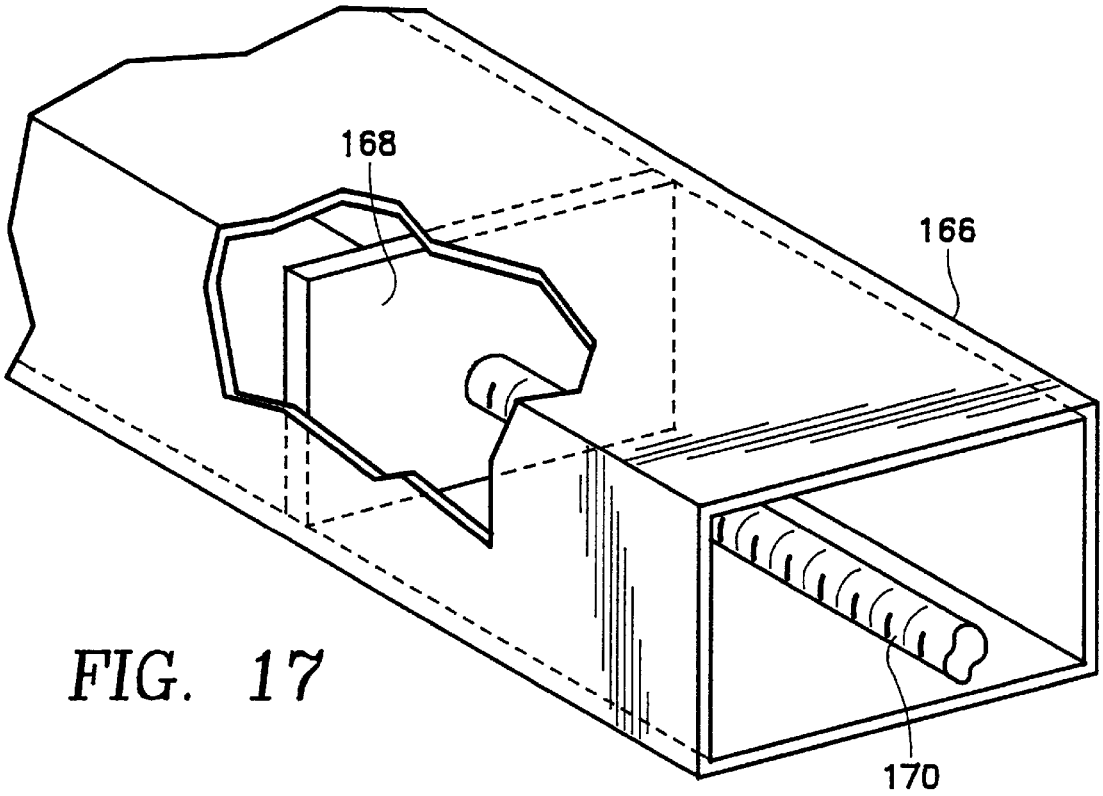
FIG. 17 is a perspective view of an exemplary tube of a type included in the card deck handling unit of FIGS. 12–14.

As shown in FIG. 17, an example of one type of element included in the unit 152 is a tube 166 wherein a pusher plate 168 is welded to one end of a lead screw 170. The lead screw 170 is maintained against rotation by the pusher plate 168. The lead screw 168 is used to move the pusher plate 168 whereby cards are moved through the tube 166. In the unit 152, all tubes are oriented with their axes extending vertically.

Figure 18:
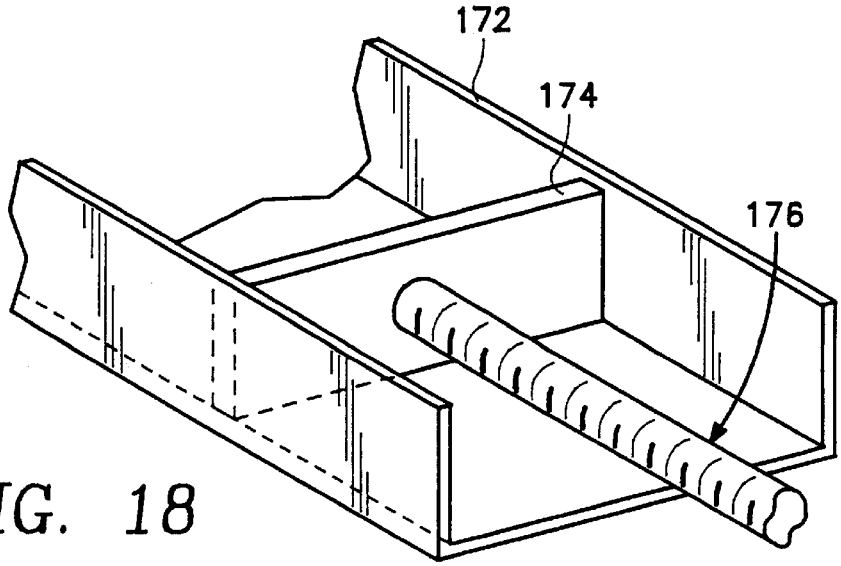
FIG. 18 is a perspective view of an exemplary channel of a type included in the card deck handling unit of FIGS. 12–14.

As shown in FIG. 18, an example of another type of element included in the unit 152 is a channel 172 wherein a pusher plate 174 is welded to one end of a lead screw 176. Like the lead screw 170, the lead screw 176 is not rotatable; it is used to move the pusher plate 174 whereby cards are moved through the channel 166. In the unit 152, all channels are oriented with their axes extending horizontally.

Figure 12:
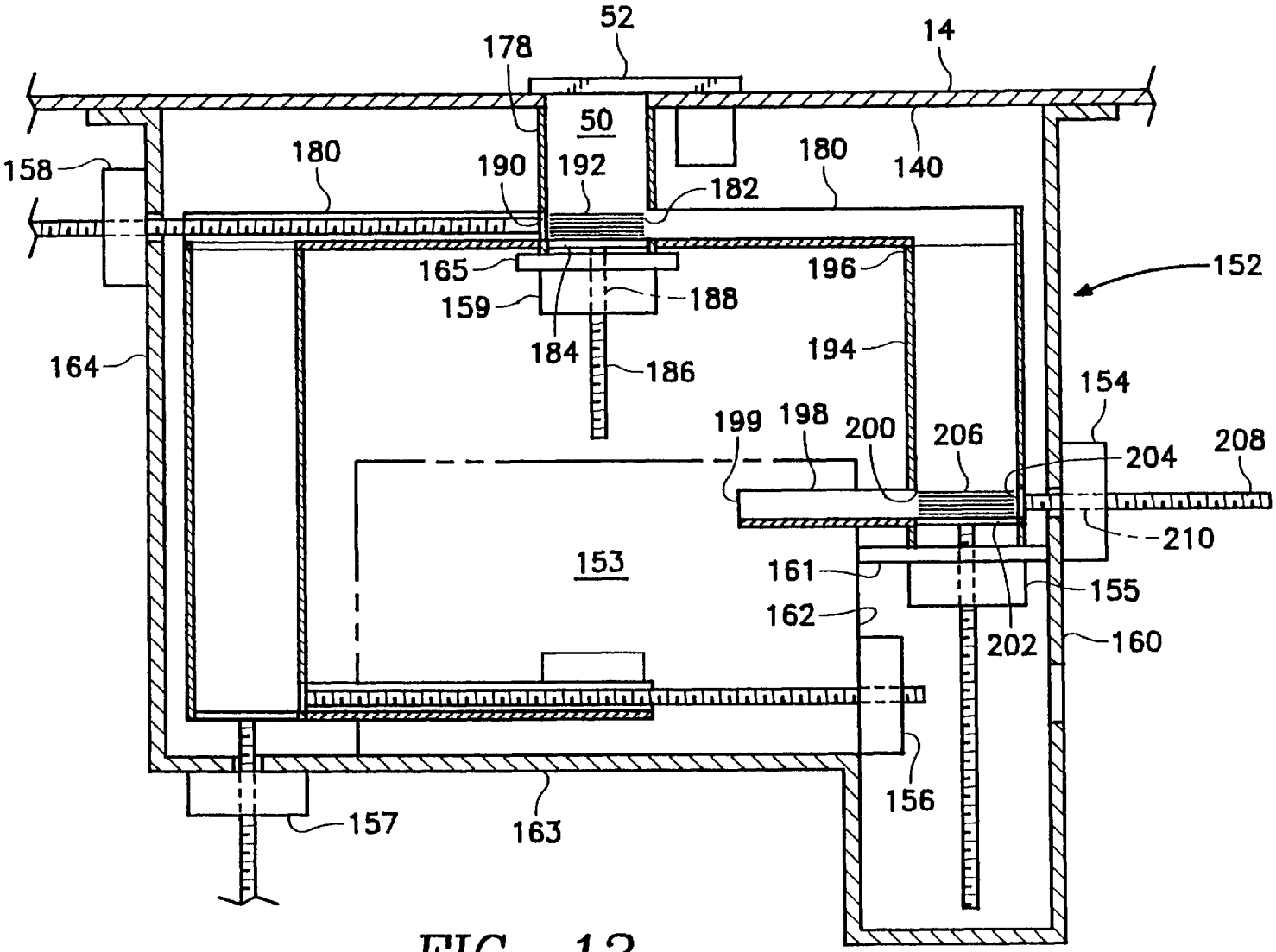
FIGS. 12–16 are section views of a card deck handling unit where a pair of card decks are shown at various locations therein.

The card dispensing hole 50 is contiguous with an interior portion of a tube 178 (FIG. 12). The card dispensing hole 50 is covered by the cover 52 to shield from view a card within the card dispensing hole 50.

The tube 178 and a channel 180 form an intersection 182 proximal to the wall 165. A pusher plate 184 is at a bottom end of the intersection 182. The pusher plate 184 is connected to a lead screw 186 that engages threads within a hole 188 through the motor 159. The threads within the hole 188 are rotatable to cause the lead screw 186 to move the pusher plate 184 towards the cover 52.

A pusher plate 190 is within the channel 180 at a boundary of the intersection 182. A deck of cards 192 is within the intersection 182.

The channel 180 is connected to a tube 194 at an end 196. The tube 194 and one end of a channel 198 form an intersection 200 proximal to the wall 161. The other end of the channel 198 is an entry port 199 of the shuffler 153.

Pusher plates 202, 204 are at boundaries of the intersection 200. The pusher plate 204 is connected to a lead screw 208 that engages threads within a hole 210 through the motor 154. A deck of cards 206 is within the intersection 200.

Figure 13:
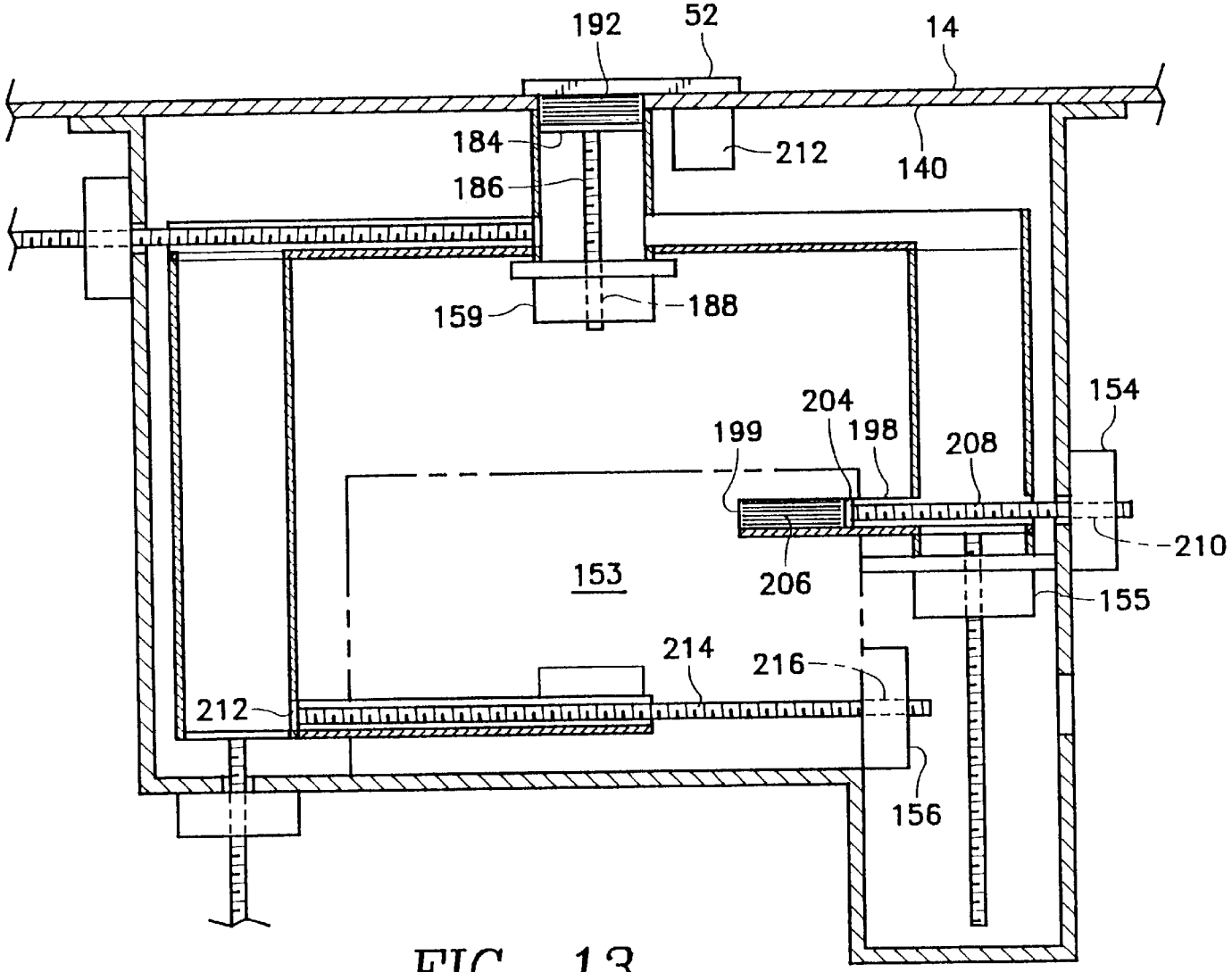

As shown in FIG. 13, the threads within the hole 210 are rotated to cause the pusher plate 204 to move the deck 206 to the entry port 199. Additionally, the threads within the hole 188 are rotated to cause the pusher plate 184 to move the deck 192 proximal to the cover 52.

A motor 212 is connected to an underside 14U of the tier 14. The motor 212 has a shaft (not shown) that passes through the tier 14 where it is connected to the cover 52. The motor 212 is operable to cause the cover 52 to cover and uncover the card dispensing hole 50 in response to a signal from the computer 42.

To move a top card from the deck 192, the card carrier 122 (FIG. 9) is positioned above the cover 52 when the motor 212 causes the cover 52 to uncover the card dispensing hole 50. Because of the cover 126, the top card remains shielded from view.

When the card dispensing hole 50 is uncovered, the card carrier 122 is lowered. The magnets 144, 146 are utilized as described hereinbefore to cause a magnetic attraction between the card carrier 122 and the top card. The card carrier 122 is then raised and the motor 212 is operated to cause the cover 52 to cover the card dispensing hole 50.

The assembly 54 operates to cause the card carrier 122 to place the top card at one of the stations 30–36. When the top card is placed at the station 36, the cover 40 is operated to maintain a concealment in a manner similar to that described in connection with the cover 52. In a similar manner, a plurality of top cards are successively placed at the stations 30–36 in accordance with play of the game.

Figure 14:
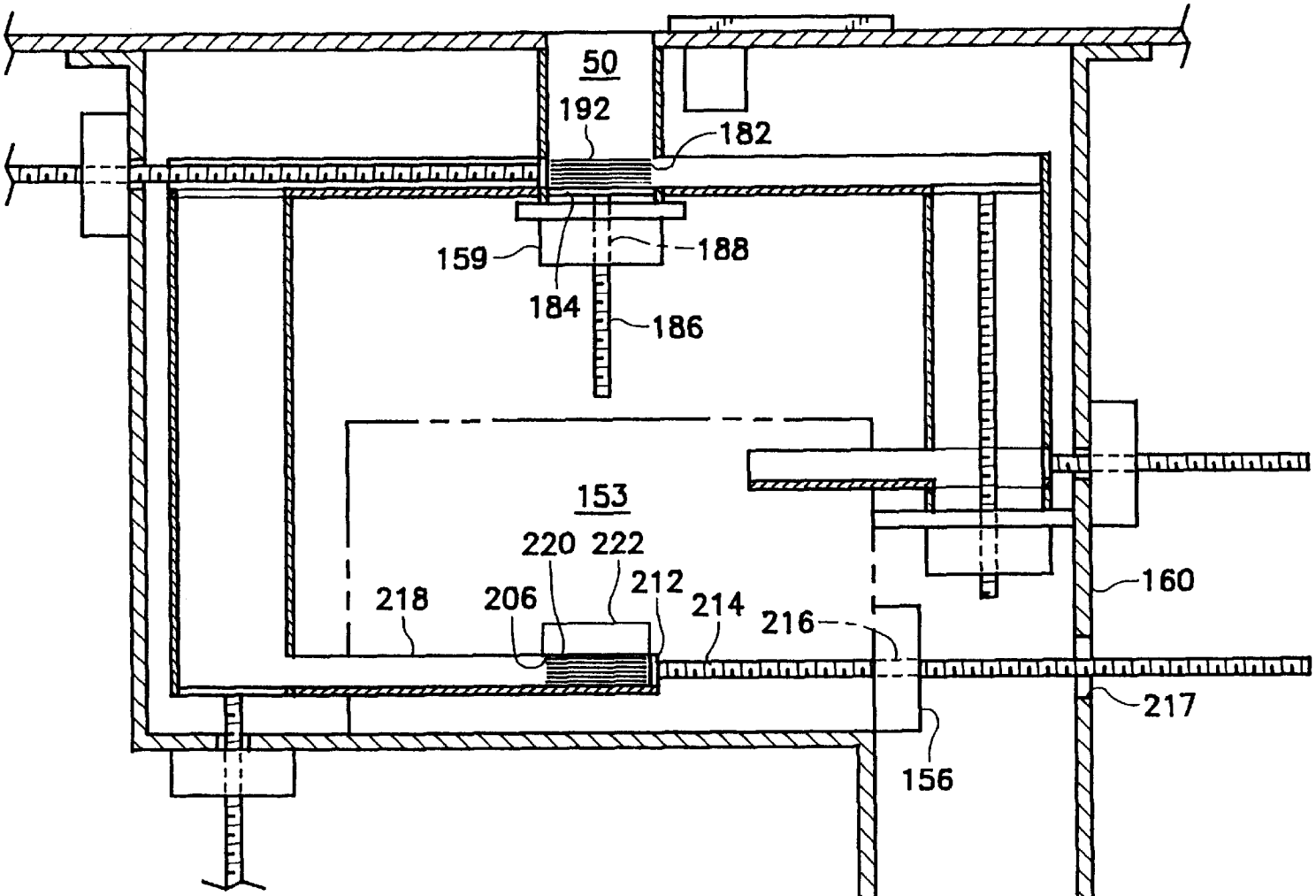

As shown in FIG. 14, when a game is completed, threads within the hole 188 are rotated to cause the lead screw 186 to move the pusher plate 184 to a bottom end of the intersection 182. Additionally, the assembly 54 is operated to cause the card carrier 122 to return cards at the stations 30–36 through the card dispensing hole 50. In an alternative embodiment, there is an additional hole through the top of table 10 where the cards are returned.

A pusher plate 212 is connected to a lead screw 214 that engages threads within a hole 216 through the motor 156. The lead screw 214 protrudes through a hole 217 through the wall 160. The threads within the hole 216 are rotated to cause pusher plate 212 to be proximal to a channel 218 at an entry port 220 thereof.

An exit port 222 of the shuffler 153 is contiguous with the entry port 220. The shuffler 153 disgorges the cards 206, newly shuffled, through the port 220 into the channel 218.

Figure 15:
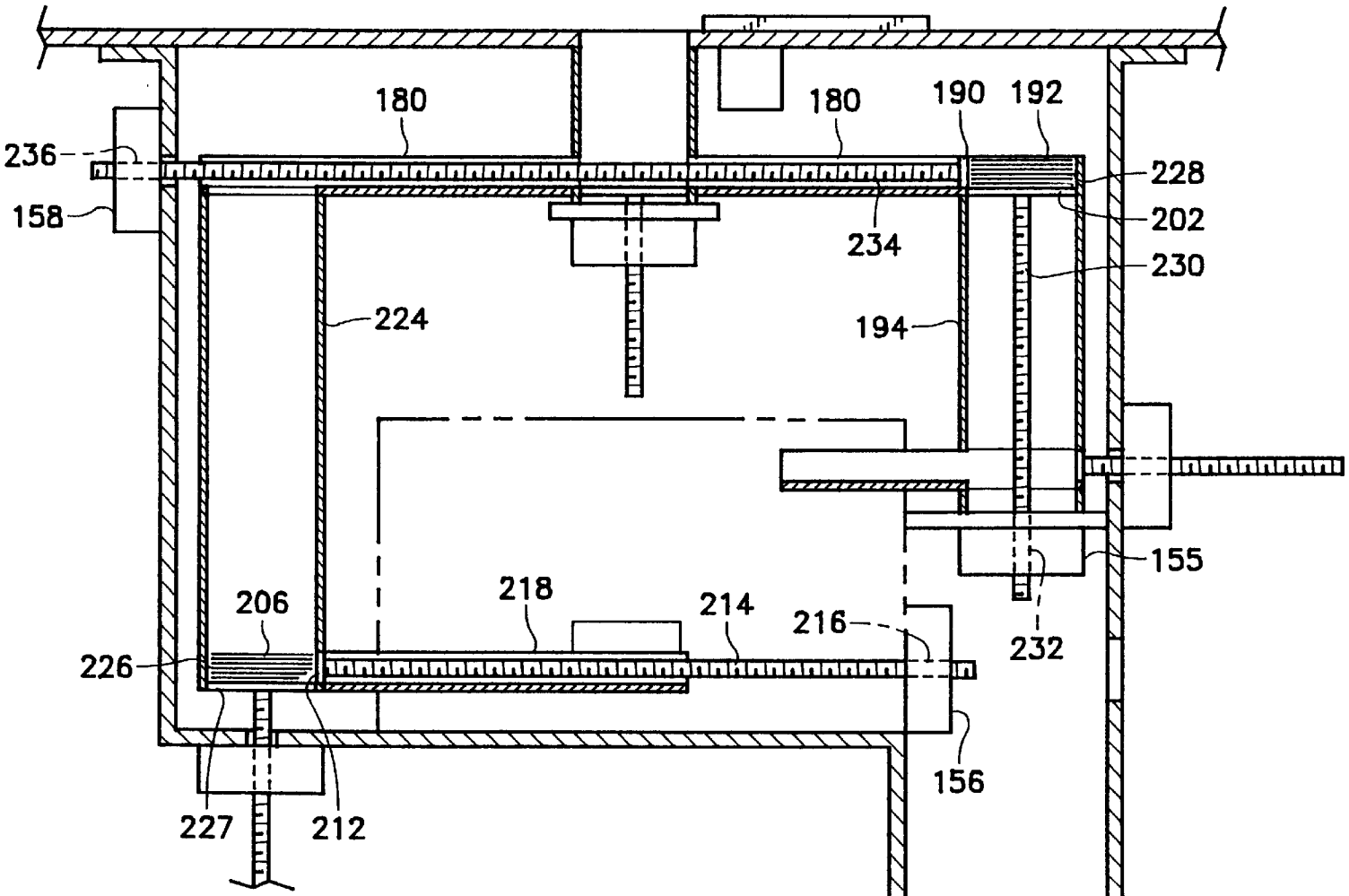

As shown in FIG. 15, the channel 218 and a tube 224 form an intersection 226. A pusher plate 227 is at a boundary of the bottom of the intersection 226. The threads within the hole 216 are rotated to cause the lead screw 214 to move the pusher plate 212 to the intersection 226 whereby the cards 206 are pushed onto the pusher plate 227.

The channel 180 and the tube 194 form an intersection 228. The pusher plate 202 is connected to a lead screw 230 that engages threads within a hole 232 through the motor 155. The threads within the hole 232 are rotated to cause the pusher plate 202 to move to a bottom boundary of the intersection 228.

The pusher plate 190 is connected to a lead screw 234 that engages threads within a hole 236 through the motor 158. The threads within the hole 236 are rotated to cause the pusher plate 190 to move the cards 192 onto the pusher plate 202.

Figure 16:
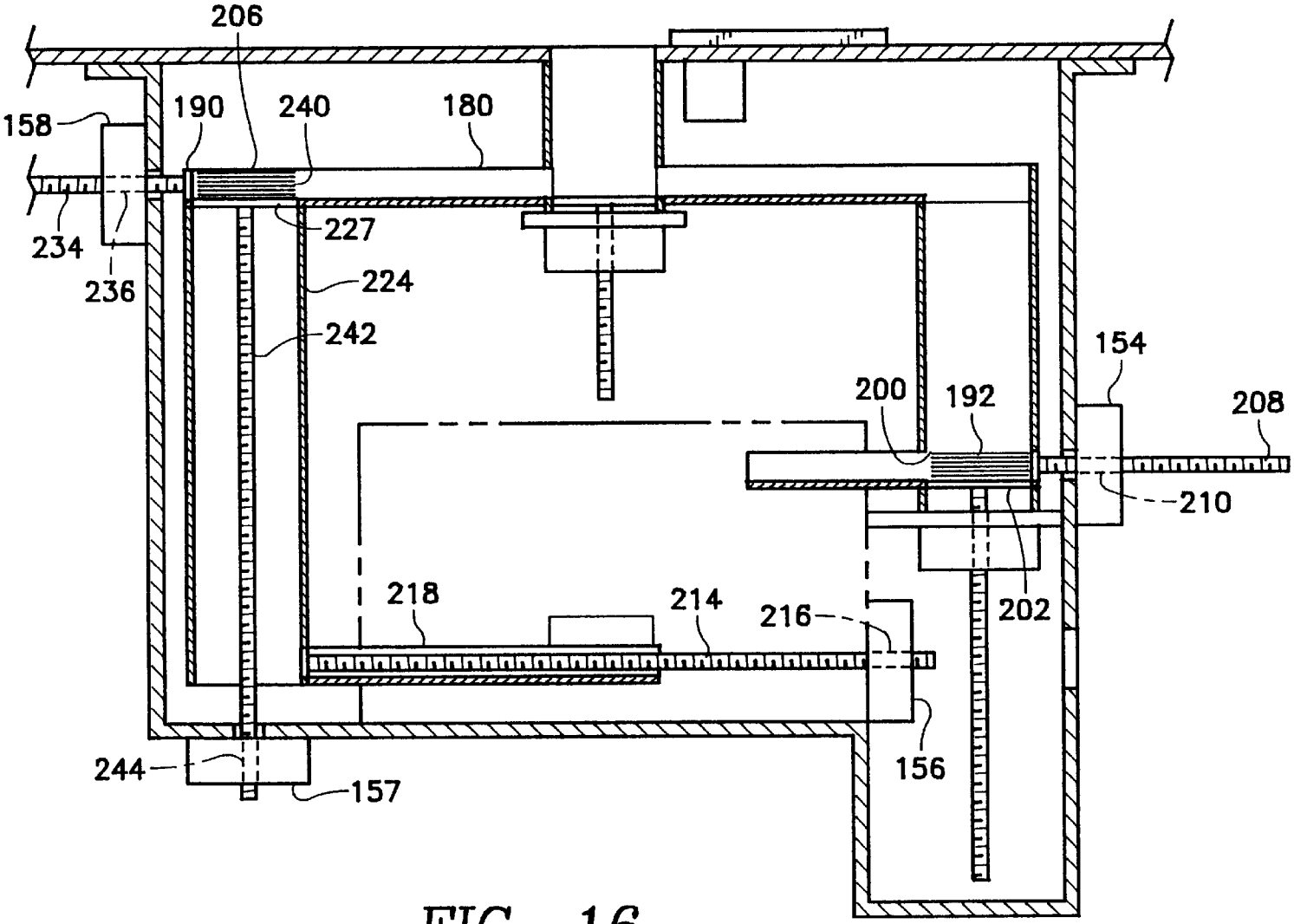

As shown in FIG. 16, the channel 180 and the tube 224 form an intersection 240. It should be understood that the intersection 240 is occluded when the pusher plate 190 or a part of the lead screw 234 is within the channel 180. The occlusion is prevented by rotating the threads within the hole 236 to cause the lead screw 234 to be outside of the channel 180 and the pusher plate 190 to be at a boundary of the intersection 240.

The pusher plate 227 is connected to a lead screw 242 that engages threads within a hole 244 through the motor 157. With the intersection 240 unoccluded, the threads within the hole 244 are rotated to cause the pusher plate 227 to push the cards 206 into the intersection 240. It should be understood that the cards 206 are within the intersection 240 preparatory to their being moved by the pusher plate 190 to the intersection 182 (FIG. 12).

The threads within the hole 232 are rotated to cause the pusher plate 202 to lower the cards 192 into the intersection 200. It should be understood that the cards 192 are in the intersection 200 preparatory to their being moved by the pusher plate 204 to the entry port 199.

As shown in FIG. 19, the player station 30 includes a player station console 246 with a video display screen 248 whereon an image of the dealer's cards at the station 36 are displayed. The console 246 additionally includes a cash insertion slot 250 where a player at the station 30 inserts cash in the form of bills. Insertion of the bills increases a balance that the station 30 player draws upon to make an initial wager prior to the start of the game and to make wagers during the game.

The console 246 has a liquid crystal display 252 whereon a display area 254 is next to a label with the word, balance, thereon. A number equal to the balance is displayed in the area 254. Therefore, when a bill is deposited into the slot 250, the number displayed in the area 254 is correspondingly increased.

The display 252 additionally includes a display area 256 proximal to a label with the word, bet, thereon. The amount of a wager made by the station 30 player is displayed in the area 256.

A pushbutton 258 with the word, bet, thereon is mounted on the console 246. When five dollars is a desired amount of the initial wager, for example, the pushbutton 258 is depressed once. In response to the pushbutton 258 being depressed, the number, five, is displayed in the area 256 and the balance is decremented by five. When ten dollars is the desired amount of the initial wager, the pushbutton 256 is depressed twice. In a similar manner, larger initial wagers are made.

Proximal to the pushbutton 258 is a pushbutton 260 with the word, reset thereon. When the station 30 player inadvertently causes the initial wager to be larger than intended, for example, it is cancelled by depressing the pushbutton 260. Thereafter, the station 30 player may again make the initial wager as described hereinbefore.

A group 262 of action pushbuttons 264–267 are mounted on the console 246. The pushbutton 264 has the word, hit, thereon. The the pushbutton 264 is depressed when the station player 30 desires to augment the hand at the station 30 with an additional card.

The pushbutton 265 has the word, stand, thereon. The pushbutton 265 is depressed when the station 30 does not desire to augment the hand.

The pushbutton 266 has the words, double down, thereon. After two cards are dealt to the station 30, the station 30 player has an option of doubling the initial wager and have the two cards augmented by one additional card. The option is excercised by depressing the pushbutton 266.

The pushbutton 267 has the word, split, thereon. After the two cards are dealt to the station 30, and the two cards are of equal rank, the station 30 player has an option of creating two hands of cards, where each hand includes one of the two cards and a third card is dealt to one of the two hands and a fourth card is dealt to the other of the two hands. The balance is decremented for a second time by the amount of the initial wager. The amount of the initial wager is made applicable to each of the two hands. It should be understood that when the third card has the rank of the two cards of equal rank, the station 30 player has an option of creating a third hand of cards.

A pushbutton 268 with the words, cash out, thereon is mounted on the console 246. When the station 30 player desires to recover the balance and leave, the pushbutton 268 is depressed. In response to the pushbutton 268 being depressed, a cash redemption voucher is disgorged through a slot 270. The voucher is redeemed for cash by a cashier (not shown).

It should be understood that prior to use of the apparatus described hereinbefore, signal representations of all card positions on the table 10 are stored in the computer 42. The signal representations of the card positions are used in placement of the card 128 on the table to and retrieval of the card 128 therefrom.

As known to those skilled in the art, blackjack players who attempt to cheat usually either count card values or use a Martingdale system of wagering. A card counter would typically occupy station 35 so that all cards dealt to the stations 30–34 can be observed prior to the card counter making a decision relevant to play at the station 35.

The card counter may additionally occupy the stations 30–34. Thus, the card counter may make minimal wagers related to play at stations 30–34 while making a large wager at station 35. A casino manager's typical response to observing such a pattern of play is to eject the card counter from the casino.

In the Martingdale system of wagering, the player initially makes a small wager. When the Martingdale player loses the small wager, a succeeding wager is made that is double the amount of the small wager. The doubling continues until the Martingdale player wins. After winning, the Martingdale player again makes the small wager and continues the doubling as described hereinbefore. The Martingdale system can be frustrated by permitting only wagers of a fixed amount.

What is claimed is:

1. An apparatus for playing a card game where a dealer station and a player station are positioned on a table top, comprising:

a transparent dome shaped cover that covers the table top;

means for moving a card to the player station and to the dealer station from a card dispensing hole through the table top and for moving said card from said table top in response to a signal from a computer; and means for providing a signal representation of the identity of said card to said computer.

2. The apparatus of claim 1 wherein said card is moved from said table top through said card dispensing hole in response to a signal from said computer.

3. The apparatus of claim 1 wherein said card dispensing hole has dimensions selected to permit passage of said card therethrough.

4. The apparatus of claim 3 additionally comprising means for shielding said card from view when it is in said card dispensing hole.

5. The apparatus of claim 4 wherein said means for shielding comprises:

a cover made from a rectangular opaque plastic slab that substantially rests upon the table top adjacent to said card dispensing hole; and a motor having a shaft connected to said cover, said shaft being rotatable to cause said cover to shield said card from view in response to a signal from said computer.

6. The apparatus of claim 1 wherein the dealer station includes a first card placement position, additionally comprising means for shielding said card from view when it is in said first card placement position.

7. The apparatus of claim 6 wherein said means for shielding comprises:

a cover made from a rectangular opaque plastic slab that substantially rests upon the table top adjacent to said first card placement position; and a motor having a shaft connected to said cover, said shaft being rotatable to cause said cover to shield said card from view in response to a signal from said computer.

8. The apparatus of claim 1 wherein the player station is positioned proximal to an arcuate edge of the table top.

9. The apparatus of claim 1 wherein said card has two face-up sides.

10. The apparatus of claim 9 wherein said card has a magnetic material embedded therein.

11. The apparatus of claim 1 wherein said means for moving comprises a card carrier that is operable to magnetically attract said card and thereby magnetically attach said card to said card carrier.

12. The apparatus of claim 11 wherein said card carrier includes an electro-magnet that attracts said card in response to a signal from said computer.

13. The apparatus of claim 11 wherein said card is coated with a non-magnetic, transparent plastic.

14. The apparatus of claim 11 wherein said card has a bar code printed thereon that identifies said card when it is attached, said means for providing comprising a bar code reader within said card carrier that provides a signal representation of the identity of said card to said computer.

15. The apparatus of claim 11 wherein said card carrier includes a cover that shields from view a card positioned beneath it.

16. The apparatus of claim 11 wherein said means for moving is a card placement assembly, comprising:

a conveyor channel;

a channel rotation motor that rotates said channel in a plane parallel to the table top in response to a signal from said computer;

a card placement lead screw disposed within said channel, said lead screw having one end rotatably connected to one end of said channel;

a lead screw motor that has its housing connected to the other end of said channel and its shaft coaxially connected to said card placement lead screw, said lead screw motor shaft axially rotating in response to a signal from said computer;

a moveable conveyor having a block with a threaded hole through which said card placement lead screw passes with threads thereof engaging threads within said threaded hole; and an arm that connects said conveyor to said card carrier.

17. The card placement assembly of claim 16, additionally comprising a plurality of wheels rotatably connected to said conveyor, said wheels rolling along said channel in response to rotation of said card placement lead screw.

18. The card placement assembly of claim 16 additionally comprising means for raising and lowering said card carrier in response to a signal from said computer.

19. The card placement assembly of claim 18 wherein said means for raising and lowering is a solenoid mounted upon said conveyor, said solenoid having a plunger connected to said arm, said plunger being alternatively retracted into said solenoid and extended therefrom in response to a signal from said computer.

20. The apparatus of claim 1, additionally comprising means for moving a first deck of cards to a position where said card is dispensed through said card dispensing hole while a second deck of cards is moved into a card shuffler.

21. The apparatus of claim 20 wherein said means for moving said decks of cards comprises:

first and second motors that have a central threaded hole therethrough wherein threads rotate in response to a signal from said computer;

a tube that is contiguous with said card dispensing hole;

a card deck shuffler;

first and second lead screws that engage threads within said first and second motors, respectively;

first and second pusher plates connected to an end of said first lead screw and an end of said second lead screw, respectively, said first motor being operable to cause said first pusher plate to move said first deck through said tube towards said card dispensing hole, said second motor being operable to cause said second pusher plate to move said second deck through an entry port of said card shuffler; and means for moving said second deck from said card shuffler towards said tube.

* * * * *